United States Patent [19]

Lapeyre

[11] Patent Number: 4,535,871

[45] Date of Patent: Aug. 20, 1985

[54] UNITARY STAIRWAY

[75] Inventor: James M. Lapeyre, New Orleans, La.

[73] Assignee: The Laitram Corporation, New Orleans, La.

[21] Appl. No.: 402,218

[22] Filed: Jul. 26, 1982

Related U.S. Application Data

[63] Continuation-in-part of Ser. No. 306,585, Sep. 28, 1981, abandoned.

[51] Int. Cl.[3] ..... E06C 9/02; B63B 29/20

[52] U.S. Cl. ..... 182/93; 182/194; 182/228; 52/182

[58] Field of Search ..... 182/100, 93, 228, 106, 182/189, 194; 52/182

[56] References Cited

U.S. PATENT DOCUMENTS

| | | | |
|---|---|---|---|
| 118,632 | 8/1871 | Morse | 182/220 |
| 1,215,352 | 2/1917 | Durinage | 182/228 |
| 2,466,155 | 4/1949 | Conrad | 182/106 |
| 4,044,857 | 8/1977 | Guerette | 182/106 |
| 4,143,740 | 3/1979 | Mathews | 182/93 |
| 4,199,040 | 4/1980 | Lapeyre | 182/93 |
| 4,333,547 | 6/1982 | Johansson | 182/219 |

FOREIGN PATENT DOCUMENTS

| | | | |
|---|---|---|---|
| 2358745 | 1/1975 | Fed. Rep. of Germany | 182/228 |
| 2518327 | 11/1976 | Fed. Rep. of Germany | 182/134 |
| 11718 | of 1899 | United Kingdom | 182/228 |
| 921383 | 3/1963 | United Kingdom | 182/228 |
| 501006 | 7/1976 | U.S.S.R. | 182/93 |

*Primary Examiner*—Reinaldo P. Machado
*Assistant Examiner*—Alvin Chin-Shue
*Attorney, Agent, or Firm*—Weingarten, Schurgin, Gagnebin & Hayes

[57] ABSTRACT

A stair or ladder which has a central stringer adapted for mounting between an upper level and a lower level at a relatively steep angle of inclination, and a plurality of tread members disposed in alternating arrangement on respective sides of the stringer, each of the tread members having a foot support portion outwardly extending from the stringer. A pair of handrails is disposed substantially in a plane forward and parallel to a plane passing through the front edges of the foot support portions and positioned with respect to the foot support portions to provide support of the user. The tread members are substantially identical, except for the top tread and bottom tread of the stairway and include a foot support portion and an outwardly extending support adapted for connection to a rail. The stairway is preferably composed of components preformed of aluminum and welded together to provide a completed structure which is relatively light weight, rigid, and strong.

9 Claims, 27 Drawing Figures

UNITARY STAIRWAY

RELATED APPLICATION

This application is a continuation-in-part of copending application Ser. No. 306,585, filed Sept. 28, 1981, now abandoned.

FIELD OF THE INVENTION

This invention relates to stairs and ladders, and more particularly to a stair or ladder having alternating half treads and which can be installed at relatively steep inclinations.

BACKGROUND OF THE INVENTION

A ladder is disclosed in U.S. Pat. No. 4,199,040, of the same inventor and assignee as this invention, which comprises a single stringer or central tread support disposed between upper and lower levels at a predetermined angle of inclination and having an array of half treads on each side of the stringer, each array being vertically spaced from the other along the length of the stringer. The half treads are affixed to and laterally extend from the respective sides of the stringer, and each includes an integral outwardly extending member which terminates in a plane which is forward of a plane passing through the front edges of the treads. First and second handrails are disposed in this forward plane and are affixed to and supported by the members outwardly extending from the treads. This novel ladder can be disposed at a relatively steep angle in comparison to a conventional ladder of the same tread width and riser height and provides sufficient safety and comfort to permit face-forward descent of the ladder, even without holding onto the handrails.

Ladders are known in which treads or rungs are alternately arranged along a single stringer or pole, as shown in U.S. Pat. Nos. 4,061,202 and 4,069,892. In ascending and descending ladders of this known type, a user must face the ladder and support himself by holding onto the rungs to guide his ascent or descent. Such ladders cannot be descended facing forwardly, as with a stairway, and these ladders require a fair degree of dexterity on the part of a user and are not very comfortable to use.

In most stairways, the treads extend uniformly across the width of the stairway, each tread being of the same front-to-back dimension. The treads are supported by one or more stringers. Examples are shown in U.S. Pat. Nos. 3,310,312 and 3,467,220. Stairways are shown in U.S. Pat. Nos. 858,199 and 4,125,175 in which the treads are set back on alternate half portions to provide foot clearance in moving from the non-set-back portion of a tread to the next non-set-back portion of a succeeding tread, for the purpose of facilitating use of the stairway which is inclined at a relatively steep angle of inclination. In the structure of U.S. Pat. No. 858,199, each tread has a set-back portion and a non-set-back portion and is disposed between and supported by a pair of side stringers. In the structure of U.S. Pat. No. 4,125,175, the treads are similarly constructed and are each connected to an adjacent tread by a pair of vertical supports. Neither of these disclosed stairways employs any handrails.

SUMMARY OF THE INVENTION

The present invention relates to a stair of the type shown in U.S. Pat. Nos. 4,199,040 and 4,316,524 of the same inventor and assignee. The invention comprises a stair or ladder which has a central stringer adapted for mounting between an upper level and a lower level at a relatively steep angle of inclination, a plurality of tread members disposed in alternating arrangement on respective sides of the stringer, each of the tread members having a foot support portion laterally extending from the stringer and a pair of handrails disposed substantially in a plane forward and parallel to a plane passing through the front edges of the foot support portions and positioned with respect to the foot support portions to provide support of the user. The tread members are substantially identical, except for the top tread and bottom tread of the stairway and include a foot support portion and at least some provide an outwardly extending support adapted for connection to a rail which may be a handrail or separate support rail.

The handrails are disposed substantially in a plane forward and parallel to a plane passing through the front edges of the foot support portions, and the handrails are of a spacing therebetween to confront the sides of a user's body to provide side support to the user's body. The handrail spacing is sufficient to provide clearance to permit the normal side-to-side movements of the user's body in using the stair. For persons of average size, the handrail spacing is typically 17–20 inches. The handrails are also of a height to lie under the arms of a user and to permit the arms to pass over the handrails while descending the ladder to provide comfortable and positive support in descending the ladder even at very steep angles. Additional support to a user descending the stairway is provided by the central stringer, which has an outer surface flush with or slightly extending outward from the front edges of the foot support portions and which serves as a rest or bumper for a user descending the stairway, and also as a shield for the tread edges. To further add comfort and protection to the user, this stringer may be covered with a resilient material such as rubber.

The stairway, in preferred embodiment, is composed of components preformed of metal such as aluminum or steel and welded together to provide a completed structure ready for installation which is relatively light weight, and extremely rigid and strong. Whereas the completed structure is preferred, it is anticipated that in some instances the parts may be precut and formed and shipped as a kit for field or remote assembly. The stairway can be advantageously employed in shipboard as well as land-based environments.

DESCRIPTION OF THE DRAWING

The invention will be more fully understood from the following detailed description taken in conjunction with the accompanying drawing, in which.

DETAILED DESCRIPTION OF THE INVENTION

Figure 1:
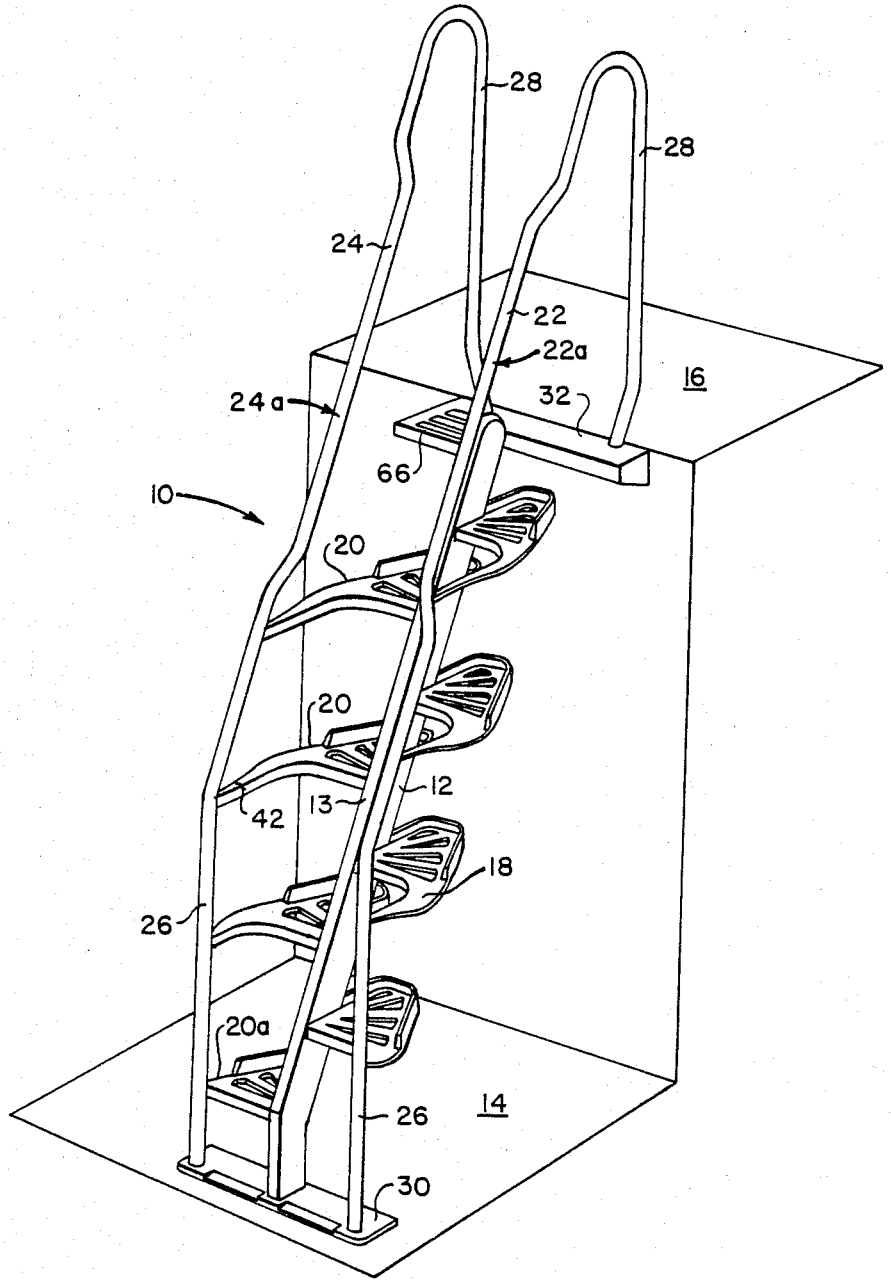
FIG. 1 is a perspective view of a preferred embodiment of the stairway of this invention.

With reference now to FIGS. 1 through 4, the stairway 10 of this invention includes a central tread support or stringer 12, which extends between a lower surface 14 and an upper surface 16. Disposed on one side of central stringer 12 is an array of equally spaced half treads 18, and disposed on the other side of central stringer 12 is another array of equally spaced half threads 20. The half treads 18 are offset from half treads 20 along the length of stringer 12 to form an alternating array. Each half tread 18 and 20 has a lateral extent and depth sufficient to accommodate and support one foot of a person using the ladder and normal outward angling of that foot. A resilient strip 13 may be disposed along stringer 12 and serves as a protective bumper for a user descending the stairway.

Figure 2:
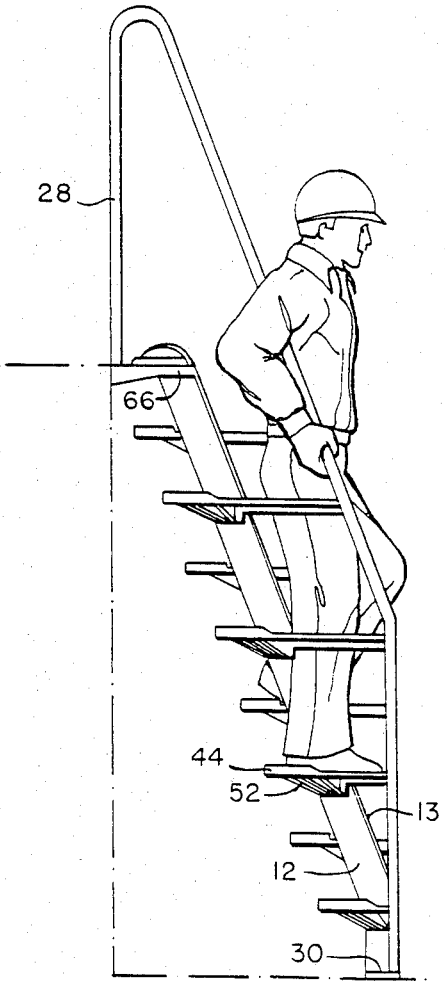
FIG. 2 is a side view of the stairway of FIG. 1 illustrating a user descending the stairway.

A pair of handrails 22 and 24 are disposed forwardly of the treads and in a plane forward and generally parallel to a plane passing through the front edges of the treads. The handrails 22 and 24 include vertical lower sections 26 and upper sections 28, which with adjoining portions of inclined handrails are more widely spaced than the intermediate section of the handrails to provide hip clearance for a user entering and exiting the stairway for ascent or descent. The handrails are positioned at a height in relation to the treads to provide body control support for a person using the stairway, and are of a height to comfortably provide the user with underarm support. Preferably, the handrails are of a height to be under the arms of a user while descending the stair, as illustrated in FIG. 2. A lower support plate 30 is affixed to stringer 12 and handrails 22 and 24 and secures the stair to the lower surface 14. An upper support 32 secures the stair to the upper mounting surface.

Figure 2A:
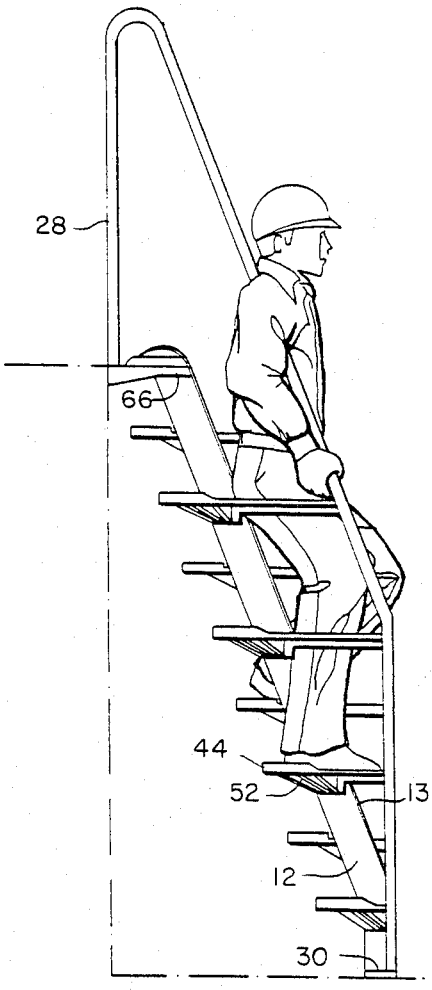
FIG. 2A is a side view of the stairway of FIG. 1 illustrating use of the central stringer and handrails as secure rests for a user descending the stairway.
Figure 3:
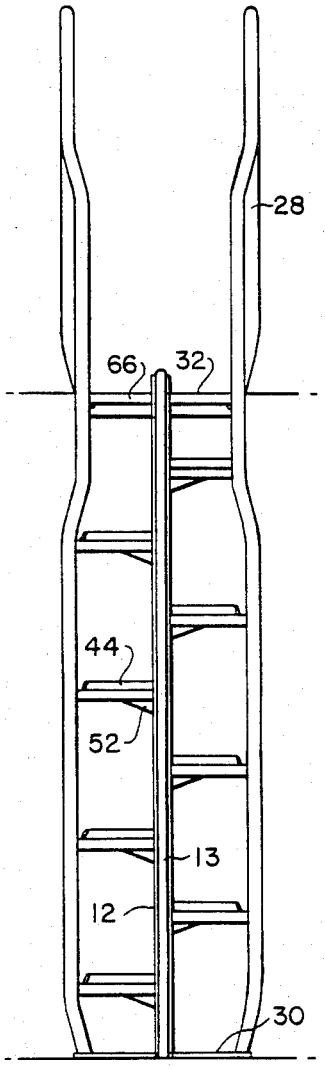
FIG. 3 is a front view of the stairway of FIG. 1.

The handrails are spaced to be slightly wider than the width of persons using the stairway such that the central sections of the handrails 22*a* and 24*a* confront the sides of a user's body to provide side support to a user ascending and descending the stairway. The closeness of fit should allow for normal slight side-to-side motions of the user's body. As described, the handrails are of a height to be under the arms of a user while descending the stair, and it is preferable that the handrails be of a height to lie between the hips and armpits of a user while descending the stairway. The forward edge of stringer 12, which can include the resilient strip 13, is flush with or slightly outward of the front edges of the foot support portions and serves as a rest or bumper for a user descending the stairway, and as a shield for the tread edges. As illustrated in FIG. 2A, a user may rest his buttocks on the stringer during descent of the stairway and may slide along the stringer during descent for secure use of the stairway even under severe conditions, as on a rolling or pitching ship. The combination of buttock, arm pit, hand, and foot support provide an extremely secure user purchase on the stair even during severe motions of a ship in rough seas.

The stairway 10 may be deployed at any desired angle between upper surface 16 and lower surface 14, the exact angle depending upon the nature of the use desired, and the length of the stairway, although the angle is preferably greater than 45° but not in excess of 80°. To accommodate the usual range of adult sizes, the half treads 18 and 20 have a width typically of about 5 to 12 inches. The depth of the treads (from front to back) is typically 4 to 12 inches, and the riser height between adjacent treads typically can be 5 to 11 inches. It is desirable that the front edges of the tread members on either side of the stringer 12 overlap the tread member immediately below and to the same side of the stringer so as to provide shoe heel clearance for the user. This overlap approximates 1½" minimum.

Whereas other materials such as wood and fiberglass reinforced plastic may be used for this stairway, the stairway is preferably fabricated of preformed metal components such as aluminum and steel. The stringer 12 is fabricated of rectangular aluminum tubing. The handrails 22 and 24 are of round aluminum tubing bent to the intended shape. The tread members and support plates are preformed of aluminum castings. These constituents are factory welded together to form the stairway of intended length, or may be shipped as a kit for remote assembly.

Figure 5:
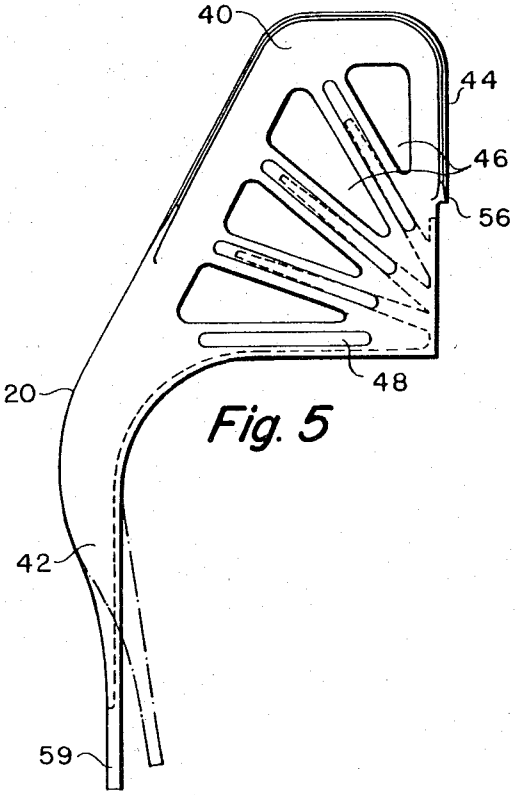
FIGS. 5–7 are top, front elevation, and side elevation views, respectively, of the tread member employed in the stairway of FIG. 1.
Figure 6:
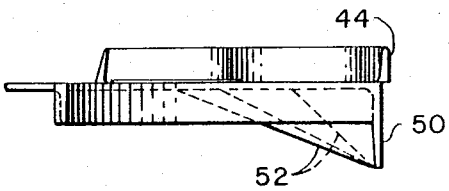
Figure 7:
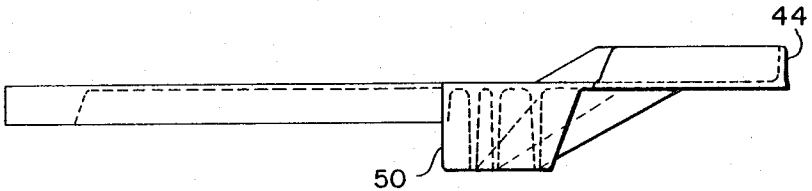

A tread member 20 is shown in FIGS. 5–7 and which is employed in an array along the length of the stairway, except for the uppermost and lowermost tread. The tread member includes a foot support portion 40 of generally trapezoidal outline, and an outwardly extending arm 42 adapted for attachment to a support or handrail. The illustrated tread member is for the left side of the stairway as viewed when facing the stairway. A similar tread member is provided for the right side of the stairway which is of complementary construction, and as readily seen in FIG. 1, the left and right tread members are mirror images of each other. The tread members are preferably cast of aluminum with all constituents being integrally formed. A flange 44 upwardly extends around a portion of the inward perimeter of the foot support portion to serve as a skid stop for a user's foot and to enhance structural strength. Openings 46 are provided through the foot support portion to lessen the weight of the structure, and to provide drainage and minimize ice build-up and a pattern of recesses 48 are provided across the foot support portion and in which may be disposed a non-slip material such as carborundum to provide a good gripping surface for a user's foot. The side of the foot support portion confronting the stringer includes a downwardly extending flange 50 from which one or more webs 52 are disposed and angularly extending to the bottom surface of the foot support portion to provide a rigid, strong, lightweight structure. The outer end portion 59 of the arm 42 may be formed to desired positions, as illustrated in dotted outline, to be aligned with and joined to the adjacent portion of a support or handrail. The flange 50 of the foot support portion is attached to the side of the central stringer 12, with the end 56 of the upper flange 44 abutting the undersurface of the stringer, as illustrated in FIG. 1. The distal end of the arm 42 is attached to the associated support or handrail. The outer end portion of the arm 42 is bent and cut and shaped to a length sufficient to permit joining of the arm to the handrail at the particular position along the length of the stairway. The end portion is relatively thin and is readily cut and milled to length and shape. Preferably two shapes are cast, one where the arm 42 is directed inward, as shown in dotted form in FIG. 5, for attachment to a narrower handrail spacing, and the other where the arm 42 extends straight out for attachment to a wider support or handrail spacing. Preferably, each tread is welded to the stringer and handrail. It is preferable but not always necessary that each tread be equipped with the arm portion 42. The arm may be cut off or the tread of FIG. 8 used when no arm is required for rail support.

Figure 8:
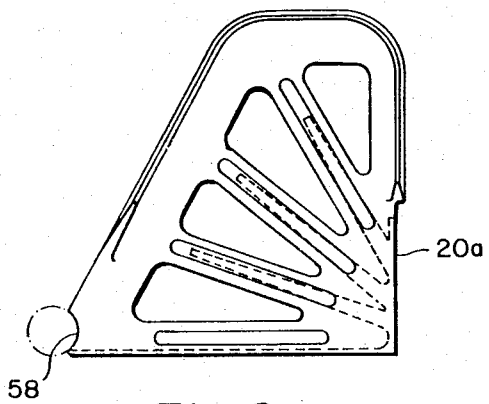
FIGS. 8–10 are top, front elevation, and side elevation views, respectively, of the lowermost tread member.
Figure 9:
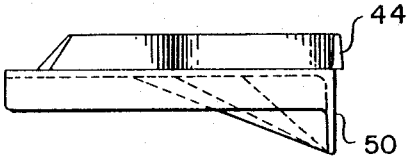
Figure 10:
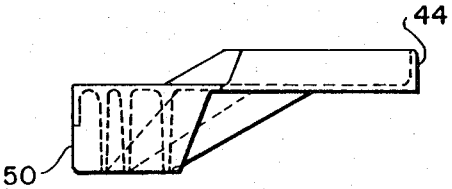
Figure 11:
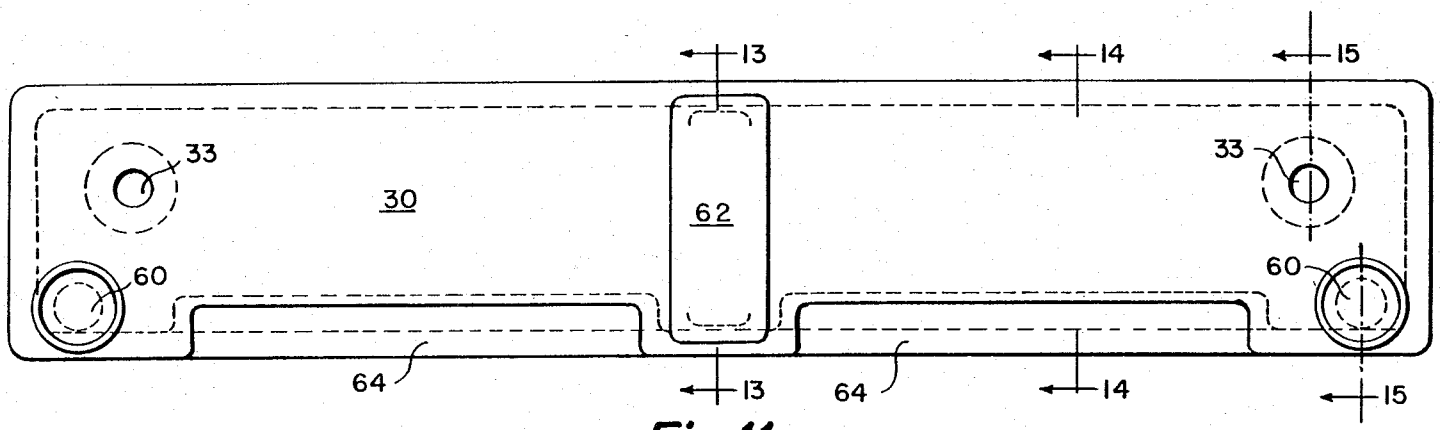
FIGS. 11 and 12 are top and front elevation views, respectively, of the bottom mounting plate.
Figure 12:
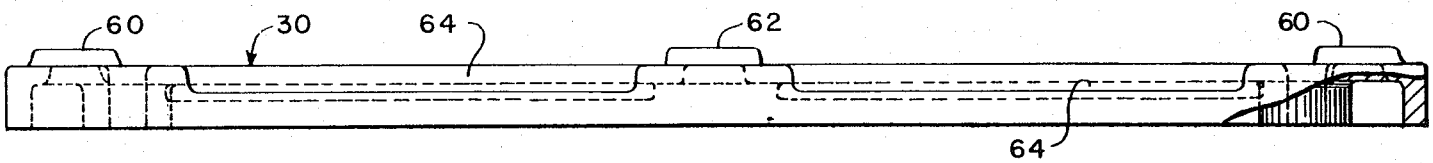
Figure 15:
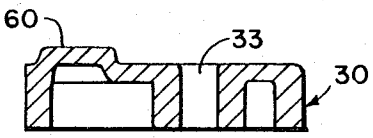
FIGS. 13–15 are sectional views taken along the corresponding portions of FIG. 11.
Figure 14:
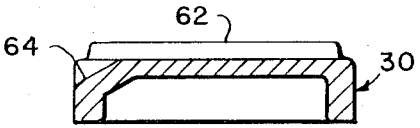
Figure 13:
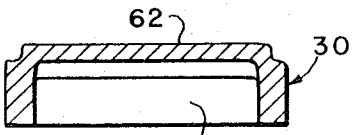
Figure 19:
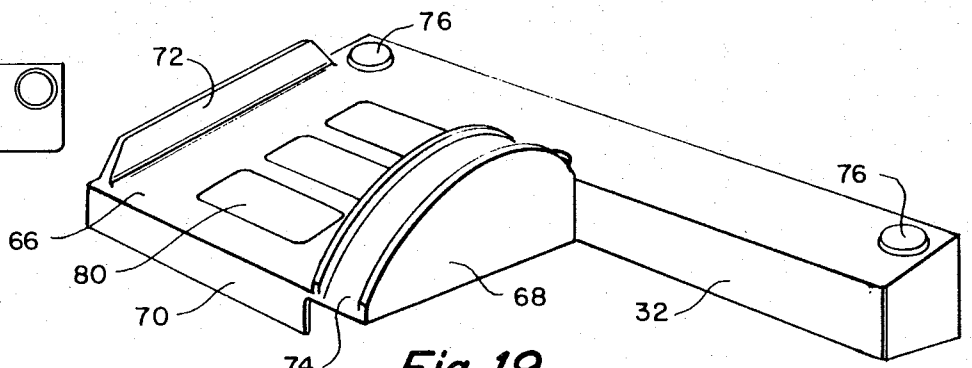
FIGS. 16–19 are top, front elevation, side elevation, and pictorial views, respectively, of the uppermost tread member.
Figure 18:
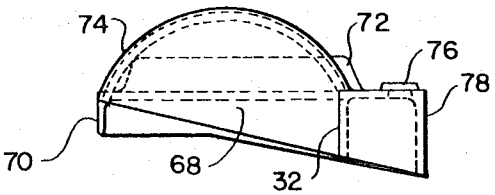
Figure 16:
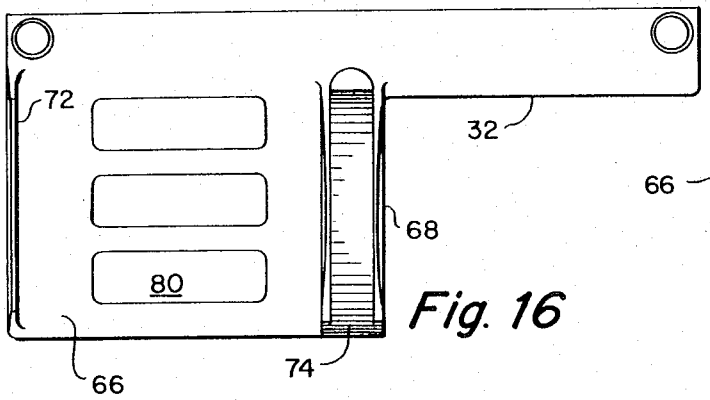
Figure 17:
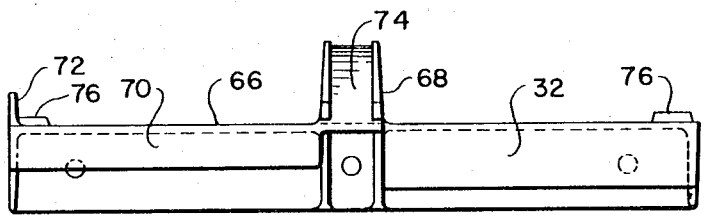

The lowermost stair tread 20*a* is illustrated in FIGS. 8–10, and is the same as the foot support portion of the tread described above. No outwardly extending arm is needed for this lowest tread position. The flange 50 of this tread member is welded to the confronting side surface of the stringer, and the outward forward corner 58 of the tread 20*a* is curved to accommodate and be joined to the lower portion of a handrail, as seen in FIG. 1.

The bottom mounting plate 30 for the stairway is preferably a casting or stamping and is illustrated in FIGS. 11–15 and is of generally rectangular plate-like configuration. A pair of upwardly extending projections 60 are adapted to receive the respective lower ends of the handrails 22 and 24 which are welded thereto. A central rectangular projection 62 is provided to receive the lower end of the central stringer 12. The portions of the support between the stringer and the handrails accessible to a user's foot have the forward ends 64 downwardly tapered to avoid a front edge over which a user could trip.

The bottom of the mounting plate 30 is hollowed out sufficiently to accommodate an attachment plate (not shown), which is used in cases where the stair is to be attached to a lower surface 14 which is of a dissimilar material. For instance, if an aluminum stair is to be installed on a steel ship's deck, a steel plate properly configured and drilled is first welded to the ship's deck. The lower aluminum mounting plate 30 is then placed over the welded steel plate and bolted in place. To prevent electrolysis between dissimilar materials, a coating or material can be interposed to electrically insulate the dissimilar materials.

The uppermost tread member is likewise preferably a casting or stamping and is shown in FIGS. 16–19 and includes a generally rectangular foot support portion 66 on one side of a central curved member 68, on the other side of which extends a generally rectangular support 32. The foot support portion 66 includes downwardly extending front and side flanges 70 for structural rigidity, and an upwardly extending side flange 72 which serves as a stop against slippage by a user's foot. The curved member 68 extends above the foot support 66 as an aid to the user in properly placing his or her right foot in the beginning of a descent of the stair. The central stringer thereafter maintains the proper separation of the user's feet. The curved upper surface 74 of the central element 68 is operative to retain a resilient bumper strip 13 which also extends along the length of the upper surface of the central stringer. A pair of upward projections 76 are provided to receive the ends of the upper portion of the handrails which are welded to this upper tread member. The upper tread member is affixed flush with the upper level with which the stairway is employed. The rearward flange 78 of this tread member can be bolted or otherwise affixed to an upper mounting surface. Recesses 80 are provided in the upper surface of the foot support portion 66 and into which a non-skid material may be disposed to minimize foot slippage.

The stairway embodying the invention can be readily fabricated to intended lengths with only a small number of modular components which need be stocked by a manufacturer. The tread members need be of only four types. The upper tread member and lower tread member can be the same for any ladder configuration. In the illustrated embodiment, the foot support portions of these members are on the left side of the stairway when facing the stairway such that in ascending the stair, the left foot of a user is the first to enter the stairway and last to leave the stairway. Of course, the arrangement can be opposite, such that the right foot could be used if desired. The tread members other than the uppermost and lowermost ones are two complementary types which are the reverse of each other, and these can be used for all ladder lengths.

In practice, the upper landing 32 determines the sequence in which alternating right and left treads will begin. As shown in FIG. 1, the user always begins descending the stair beginning with his left foot regardless of the height of the stair. Therefore, the lower tread member 20*a* may in some cases be on the left side and in some cases be on the right side. So, for some ladder heights, the user will begin ascent with the left foot and for other ladder heights will begin ascending with the right foot.

Figure 20:
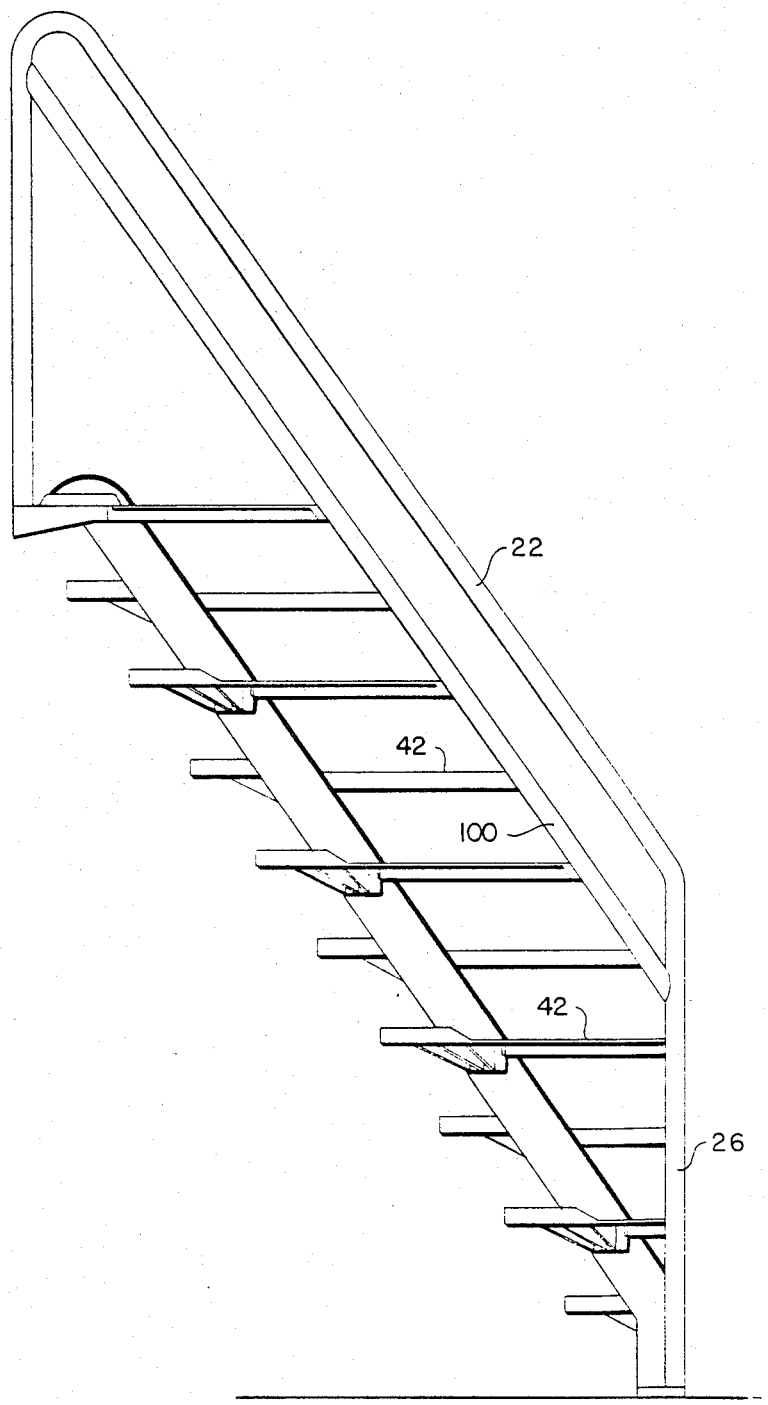
FIGS. 20 and 21 are side elevation and front elevation views, respectively, of an alternative embodiment having separate support rails and handrails and an alternate top bend.
Figure 21:
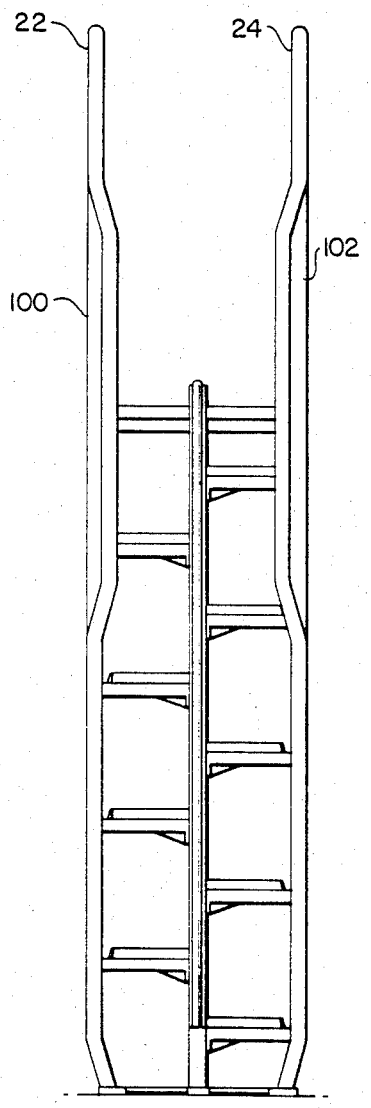
Figure 22:
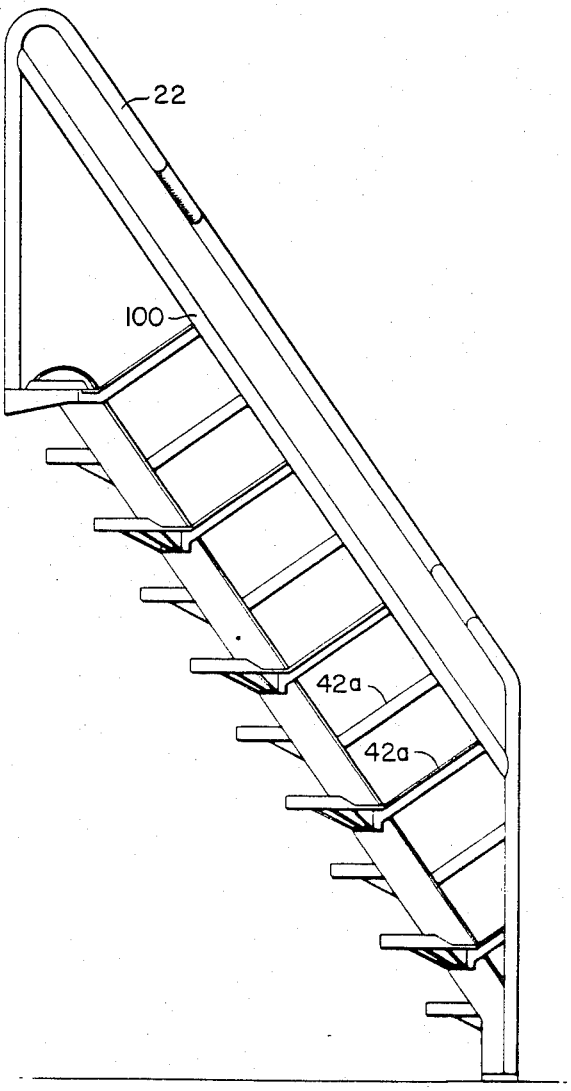
FIG. 22 is a side elevation view of a variation of the embodiment of FIGS. 20 and 21 also having an alternate top bend.

A further embodiment is illustrated in FIGS. 20 and 21 wherein the outwardly extending arms 42 of the tread members terminate at respective rails 100 and 102 which are disposed below the handrails 22 and 24. The rails 100 and 102 are of unbent straight configuration and are attached to the outer ends of the arms 42. The arms 42 of the lower tread members are attached to vertical portion 26 of handrails 22. The outer disposition of the arms 42 can therefore be the same for all of the tread members, and is useful in reducing the number of tread configurations which need be stocked in inventory for construction of any particular stair. Handrails 22 and 24 in this embodiment are unencumbered by any connections along the length thereof, thus permitting a user's hand to slide along the handrails 22 and 24 without any possibility of striking the ends of the arms. A variation of this embodiment is shown in FIG. 22 wherein the arms 42*a* are disposed upwardly to join rails 100 and 102 at substantially a right angle. This version uses less material than the version of FIG. 20 by reason of the shorter length of arms 42*a*.

Figure 23:
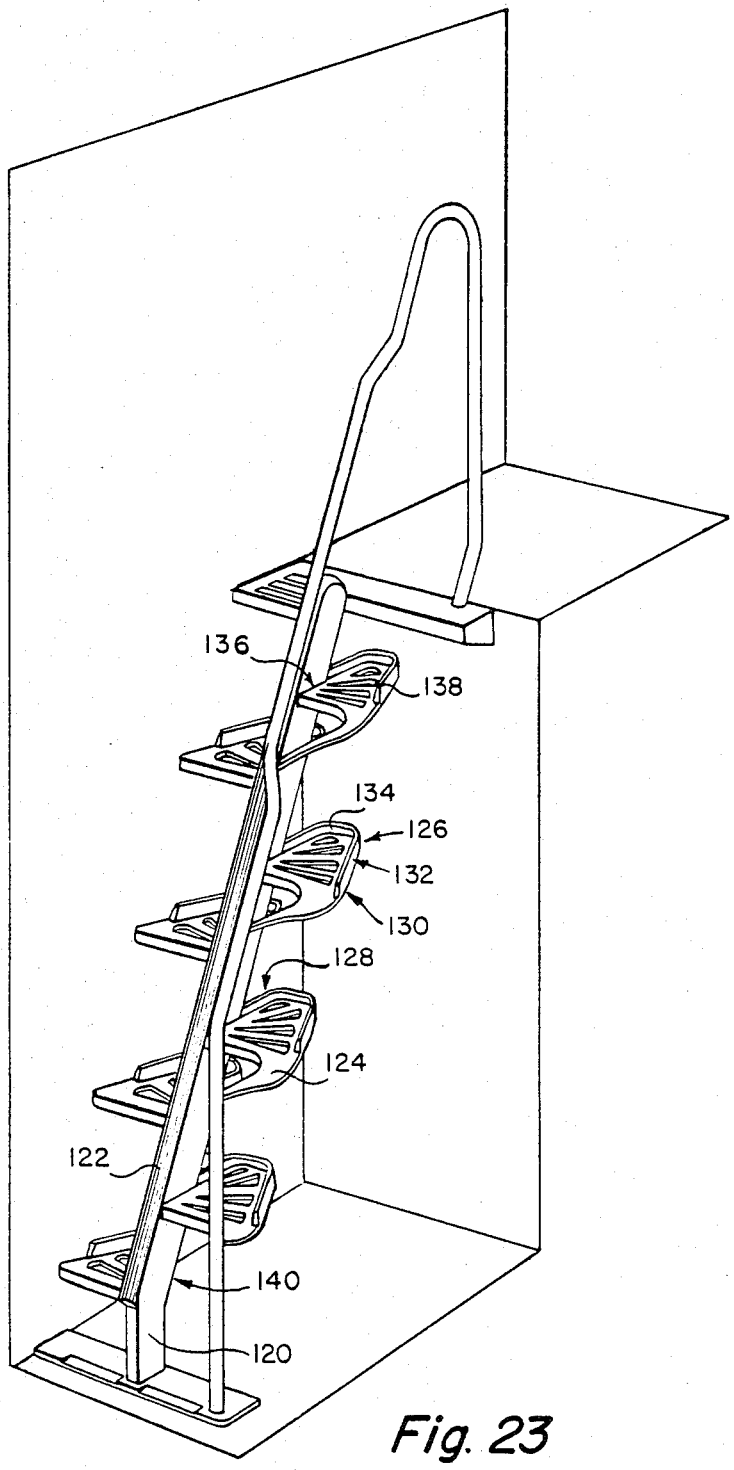
FIG. 23 is a perspective view of an embodiment disposed along a wall.
Figure 24:
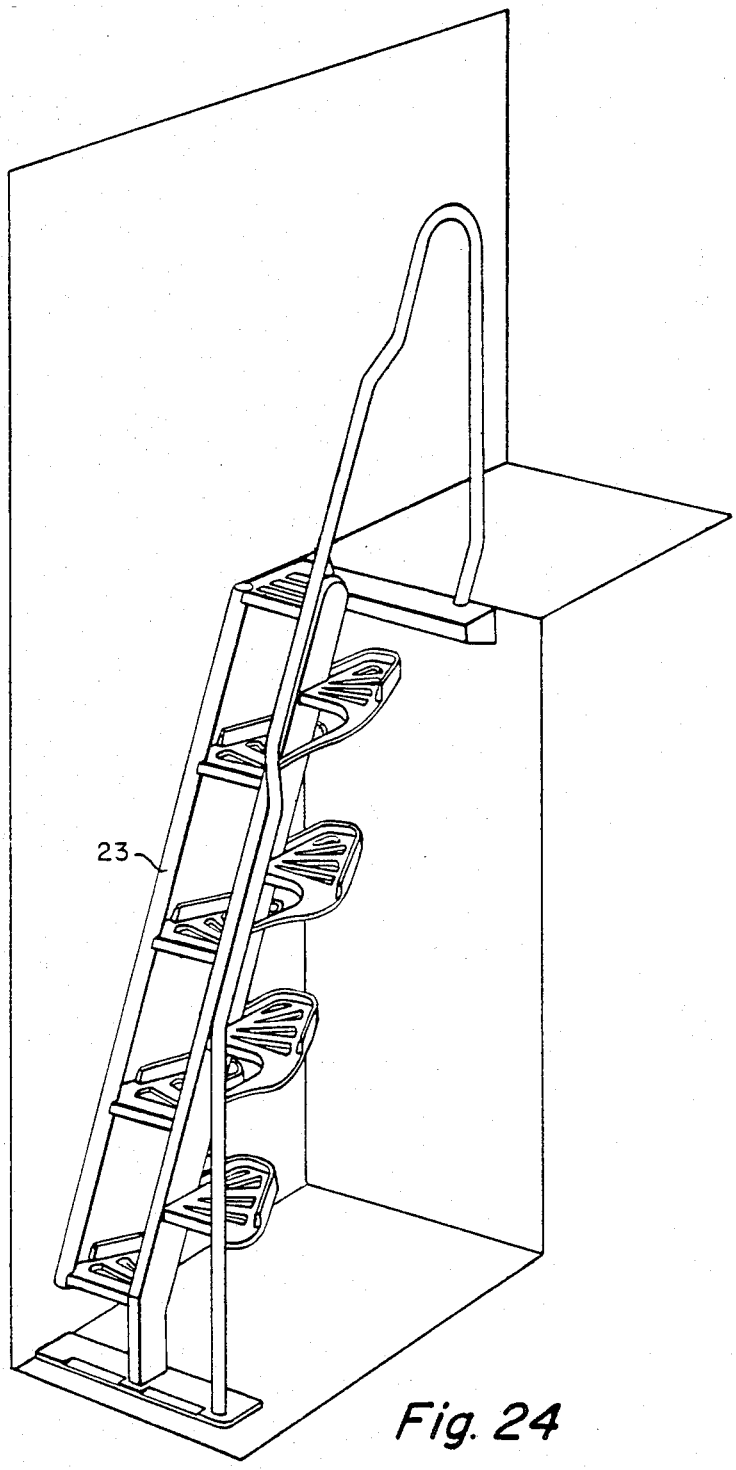
FIG. 24 is a perspective view of an embodiment similar to that of FIG. 23 and including a connecting member between the treads adjacent to the wall.

Another embodiment is illustrated in FIG. 23 in which the stairway is disposed along a wall which provides side support to a user on one side of the stairway, the other side support being provided by a handrail. This embodiment is similar to the embodiment of FIG. 1 with the elimination of one handrail and the installation of the stairway along a wall. The spacing between the wall and the outer handrail is greater than the spacing between the two handrails of the embodiments described above to provide clearance for the user's shoulders on the wall side. As illustrated in FIG. 23, the stairway includes a central tread support member 120 having a resilient strip or bumper 122 disposed on the front edge thereof. Tread members 124 are disposed in alternating arrangement on opposing sides of the support member 120. The tread members 124 have a rear edge 126, an inner edge 128, and an outer edge 130 along which a foot stop flange 132 having a substantially vertical inward facing surface 134 is provided to serve as a stop for the foot of a user. A recessed mounting portion 136 is provided on tread members 124 as shown along the inner edge 128 of tread members 124 to facilitate mounting of the members 124 to the support member 120 and to provide a continuous surface along the inner edge 128 of the tread member 124 as a guide for the foot of a user. The foot stop flange 132 extends from the rear edge 126 forward along the inner edge 128 of tread members to a flange frontal portion 138 in confronting relation with the rear edge 140 of the central tread support member 120. A variation of the embodiment of FIG. 23 is shown in FIG. 24 and includes a connecting member 23 of circular cross-section connected to the outer ends of the treads confronting the wall and which provide load distribution to those treads and additional tread support. Of course, the connecting members can be other than of circular cross section and can be, for example, rectangular, angled, or the like.

Figure 26:
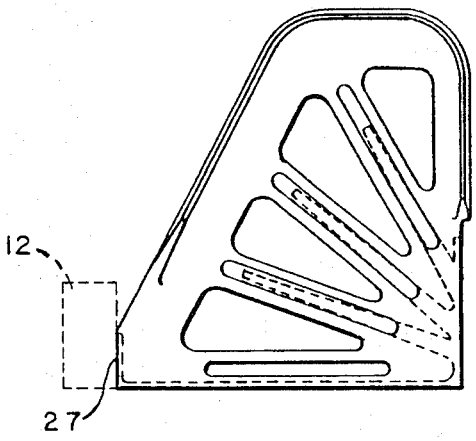
FIG. 26 is a top view of a tread member for the embodiment of FIG. 5 and having a flat welding plate for attachment to an outboard support.
Figure 4:
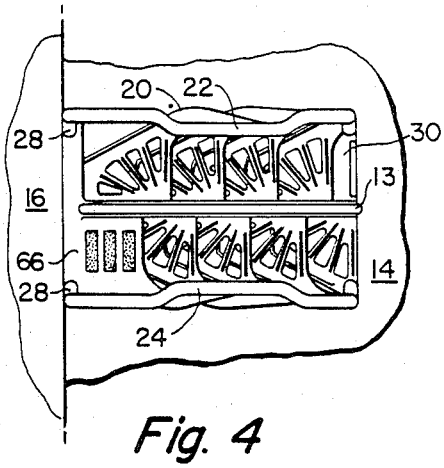
FIG. 4 is a top view of the stairway of FIG. 1.
Figure 25:
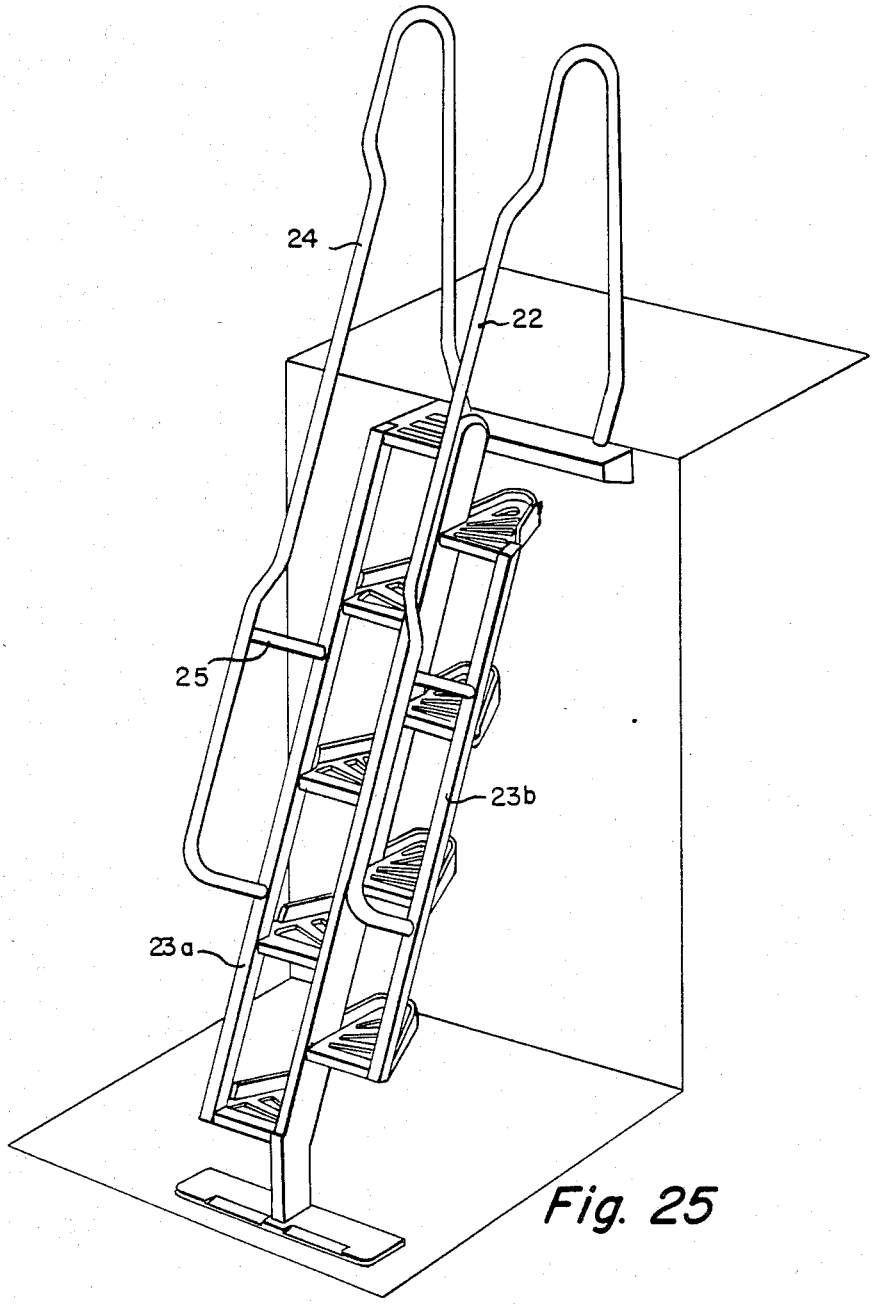
FIG. 25 is a perspective view of a further embodiment employing connecting members on each array of treads and to which the handrails are connected.

A further embodiment is shown in FIG. 25 and includes connecting members **23*a* and 23*b* which are joined to the respective arrays of tread members, and with the handrails 22 and 24 being connected to the respective connecting members. Additional intermediate supports 25 can be provided between the respective handrails and connecting members as desired to provide additional handrail support. In this embodiment, the connecting members are of rectangular cross section. The tread member for this embodiment is illustrated in FIG. 26 and is similar to the tread member shown in FIG. 8 except that a flat welding plate 27 is provided for attachment of the tread to member 23*a* or 23*b***.

The invention is not to be limited except as indicated in the appended claims.

What is claimed is:

1. A stairway comprising:

a central tread support member having a first side, a second side, a front edge and a rear edge, said central tread support member adapted for mounting between an upper level and a lower level;

a plurality of tread members including an uppermost member, a lowermost member and middle members, said middle members disposed in alternating arrangement on said first and second sides of the central tread support member, each of said middle members having a rearward periphery, an inner edge and a front edge; and an upwardly extending flange about the rearward periphery of the respective middle members to serve as a stop to a user's foot, said flange having a substantially vertical inward facing surface; an edge of said flange confronting said rear edge of the central support member;

selected ones of said middle members including a recessed mounting portion along the inner edge of the respective middle members adjacent the front edge of said middle members, said portion adapted to confront one of said sides of the central tread support member when said central tread support member and respective middle members are disposed in assembled relation.

2. The stairway of claim 1 wherein at least some of said middle members include:

a mounting plate for attaching the respective middle members to the central tread support such that said inner edges of said middle members confront the central tread support member; and at least one rib below the respective middle members for strengthening the middle members.

3. The stairway of claim 1 including a resilient bumper disposed along the front edge of the central tread support member to serve as a support for a user while descending the stairway.

4. The stairway of claim 1 wherein said central tread support member is adapted for mounting between said upper level and said lower lever level at an angle of inclination of at least 45°.

5. A stairway comprising:

a central tread support member having a first side, a second side, a front edge and a rear edge, said central tread support member adapted for mounting between an upper level and an a lower level at an angle of inclination of at least 45°;

a bumper disposed along the front edge of the central tread support member to serve as a support for a user while descending the stairway;

a plurality of tread members including an uppermost member, a lowermost member and middle members, said middle members disposed in alternating arrangement on said first and second sides of the central tread support member, said middle members having a rearward periphery, a front edge and an inner edge;

at least some of said middle members including:

an upwardly extending flange about the rearward periphery of the respective middle members to serve as a stop to a user's foot, said flange having a substantially vertical inward facing surface;

a mounting plate for attaching the tread member to the central tread support member such that said inner edge of the middle member confronts one of said sides of the central tread support members; and at least one rib below the middle member for strengthening the respective middle member;

selected middle members including a recessed mounting portion along the inner edge of the respective middle members adjacent the front edge of said members, said portion adapted to confront the respective side of said central tread support member, and an edge of said flange adapted to confront the rear edge of the central tread support member, when said central tread support member and respective middle members are disposed in assembled relation.

6. A stairway comprising:

a central tread support member having a first side, a second side, a front edge and a rear edge, said central tread support member adapted for mounting between an upper lever and a lower level;

a plurality of tread members including an uppermost member, a lowermost member and middle members, said middle members disposed in alternating arrangement on said first and second sides of the central tread support member, each of said middle members having a front edge, a rear edge, and lateral inner and outer edges;

at least some of said middle members including an upwardly extending foot stop flange on the lateral inner and outer edges and the rear edge of the respective middle members as an aid for locating the foot of a user while ascending or descending the stairway; and at least one of the inner edge foot stop flanges extending from the rear edge of the respective middle member forward to a flange frontal portion, said inner edge flange being of a length to terminate with said frontal portion in confronting relation with the rear edge of the central tread support member when respective tread members and the central tread support member are disposed in assembled relation.

7. The stairway of claim 6 including a resilient bumper disposed along the front edge of the central tread support member to serve as a support for a user while descending the stairway.

8. The stairway of claim 6 wherein said central tread support member is adapted for mounting between said upper level and said lower level of an angle of inclination of at least 45°.

9. A stairway comprising:

a central tread support member having a first side, a second side, a front edge and a rear edge, said central tread support member adapted for mounting between an upper level and a lower level at an angle of inclination of at least 45°;

a bumper disposed along the front edge of the central tread support member to serve as a support for a user while descending the stairway;

a plurality of tread members including an uppermost member, a lowermost member and middle members, said middle members disposed in alternating arrangement on said first and second sides of the central tread support member, said middle members having a front edge, a rear edge, and lateral inner and outer edges;

at least some of said middle members including an upwardly extending foot stop flange on the lateral inner and outer edges and the rear edge of the respective middle members as an aid for locating the foot of a user while ascending or descending the stairway; and at least one of the inner edge foot stop flanges extending from the rear edge of the respective middle member forward to a flange frontal portion, said inner edge flanges being of length to terminate with said frontal portion in confronting relation with the rear edge of the cental tread support member when respective middle members and the central tread support member are disposed in assembled relation.

* * * * *